United States Patent [19]

Gerlowski

[11] Patent Number: 4,913,625

[45] Date of Patent: Apr. 3, 1990

[54] AUTOMATIC PUMP PROTECTION SYSTEM

[75] Inventor: Thomas J. Gerlowski, Crafton Borough, Pa.

[73] Assignee: Westinghouse Electric Corp., Pittsburgh, Pa.

[21] Appl. No.: 134,720

[22] Filed: Dec. 18, 1987

[51] Int. Cl.[4] ..... F04B 49/00

[52] U.S. Cl. ..... 417/18; 417/19; 417/53; 417/32; 417/43

[58] Field of Search ..... 417/18, 19, 32, 43, 417/53; 413/17, 24

[56] References Cited

U.S. PATENT DOCUMENTS

| | | | |
|---|---|---|---|
| 3,091,184 | 5/1963 | Wood | 415/24 |
| 3,836,285 | 9/1974 | Portell | 417/53 |
| 4,108,574 | 8/1978 | Bartley | 417/19 |
| 4,177,649 | 12/1979 | Venema | 417/43 |
| 4,526,513 | 7/1985 | Bogel | 417/18 |
| 4,562,531 | 12/1985 | Enterline | 417/32 |
| 4,616,978 | 10/1986 | Matheson | 417/2 |

FOREIGN PATENT DOCUMENTS

| | | | |
|---|---|---|---|
| 10464 | 4/1980 | European Pat. Off. | 417/19 |
| 28780 | 2/1986 | Japan | 417/18 |

OTHER PUBLICATIONS

Simpson, Sizing Piping for Process Plants, Chemical Engineering, Jun. 17, 1968 at 192, 205–206.

Patel & Runstadler, Investigations into the Two-Phase Flow Behavior of Centrifugal Pumps, Polyphase Flow in Turbomachinery, Dec., 1978, at 79.

Murakani & Minemura, Effects of Entrained Air on the Performance of a Horizontal Axial-Flow Pump, Polyphase Flow in Turbomachinery, Dec., 1978, at 171.

Okamura and Miyashiro, Cavitation in Centrifugal Pumps Operating at Low Capacities, Polyphase Flow in Turbomachinery, Dec., 1978 at 243.

*Primary Examiner*—William L. Freeh

[57] ABSTRACT

An automatic pump protection system is comprised of a plurality of sensors for measuring process parameters indicative of a loss of pump suction or of pump motor failure. Analysis of the parameters is performed by a microprocessor in order to determine whether conditions leading to a loss of pump suction or pump motor failure are present. The microprocessor then automatically initiates pump protective action in response to the foregoing analysis by tripping the pump or by providing an alternate suction source.

16 Claims, 2 Drawing Sheets

AUTOMATIC PUMP PROTECTION SYSTEM

BACKGROUND OF THE INVENTION

1. Field of the Invention:

The present invention is directed generally to the automatic protection of equipment and, more specifically, to the automatic protection of pumps.

2. Description of the Prior Art:

In present fluid systems 9 (FIG. 1) incorporating a centrifugal pump 10, it is possible for the tank or other suction source 11 to be emptied or drained to a level such that the potential for vortex formation or air entrainment exists. Additionally, the inadvertent closing of a suction line isolation valve 14 can cause the pump to experience a total or partial loss of suction fluid. Any of these events can cause pump damage due to rotating element heat up, fluid cavitation, or air-binding of the pump casing and rotating element.

Current practice directed to the mitigation of pump damage due to loss of suction suggests the use of one of two methods of indicating loss of fluid level. In one method, a sight glass or section of clear plastic hose 12 in the pump suction source is provided as a direct visual indication of the sufficiency of fluid level. The second method incorporates a fluid level sensor 13 which alerts the operator of a low fluid level situation. There are, however, inadequacies inherent in both of these two methods of fluid level indication. In either method, the operator must recognize the low fluid level indication and must then react with the appropriate precautionary or mitigating procedure. Operator recognition and reaction times are on the order of several minutes whereas required protection steps must often be taken within seconds of the initiating event. In addition, the first method requires the operator to be present in order to make the necessary visual inspection.

The instance may occur where an operator is not present when an abnormal condition occurs or it may take several minutes for the operator to recognize the problem and take appropriate corrective action. For pumps costing tens of thousands of dollars, pumps located in hazardous environments such as a nuclear containment building, or pumps located in inaccessible locations, the protection methods of the prior art are clearly inadequate. Accordingly, the need exists for a system which is capable of automatically detecting abnormal conditions in a fluid system and automatically initiating pump protective action.

SUMMARY OF THE INVENTION

The present invention is directed to an automatic pump protection system comprised of a plurality of sensors for measuring process parameters indicative of a loss of pump suction. Analysis of the parameters is performed to determine whether conditions leading to a loss of pump suction are present. Pump protective action is automatically initiated in response to the foregoing analysis.

One embodiment of the present invention is directed to an automatic pump protection system comprised of a plurality of sensors for measuring temperature, pressure, fluid flow rate and fluid level. Analysis of the measured parameters is performed to determine whether conditions leading to vortex formation or air entrainment are present. The pump is automatically tripped or an alternate suction source is provided in response to the foregoing analysis.

According to another embodiment of the present invention, an automatic pump protection system is comprised of a plurality of sensors for measuring pressure and fluid level and for determining isolation valve position. Analysis of the monitored parameters is performed to determine whether the fluid level has dropped to a critical level or whether the isolation valve is closed, resulting in a loss of pump suction. The pump is automatically tripped or an alternate suction source is provided in response to the foregoing analysis.

Another embodiment of the present invention is directed to an automatic pump protection system comprised of a plurality of sensors for measuring pump motor vibration level, electrical current level and sound frequency/intensity as well as process parameters indicative of a loss of pump suction. Analysis of the parameters is performed to determine whether conditions indicative of pump motor failure are present in addition to conditions indicative of a loss of pump suction. The pump is automatically tripped in response to the foregoing analysis.

The automatic pump protection system of the present invention may be used in any fluid system incorporating a pump wherein the tank or other suction source can be drained to a level such that the potential for vortex formation or air entrainment exists. This type of protection system can provide for the automatic execution of precautionary or mitigating actions within seconds of the initiating event, the time frame within which such action is required if it is to be effective. The advantage of this type of system is readily apparent when compared to the prior art which provides, at best, for the manual execution of mitigating action which could occur several minutes after the initiating event, long after extensive damage to the pump has occurred. In worst case conditions, when an operator is not available, no mitigating action will be taken, likewise resulting in extensive damage to the pump. These and other advantages and benefits of the present invention will become apparent from the description of a preferred embodiment hereinbelow.

BRIEF DESCRIPTION OF THE DRAWINGS

In order that the present invention may be clearly understood and readily practiced, preferred embodiments will now be described, by way of example only, with reference to the accompanying figures wherein.

DETAILED DESCRIPTION OF THE PREFERRED EMBODIMENT

Figure 1:
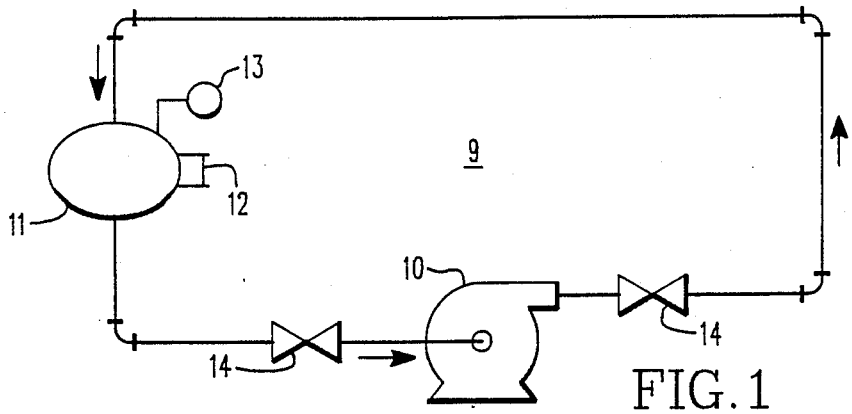
FIG. 1 PRIOR ART
FIG. 1 illustrates the prior art in pump protection systems which is comprised of a sight glass or clear plastic hose or, in the alternative, a fluid level sensor.
Figure 2:
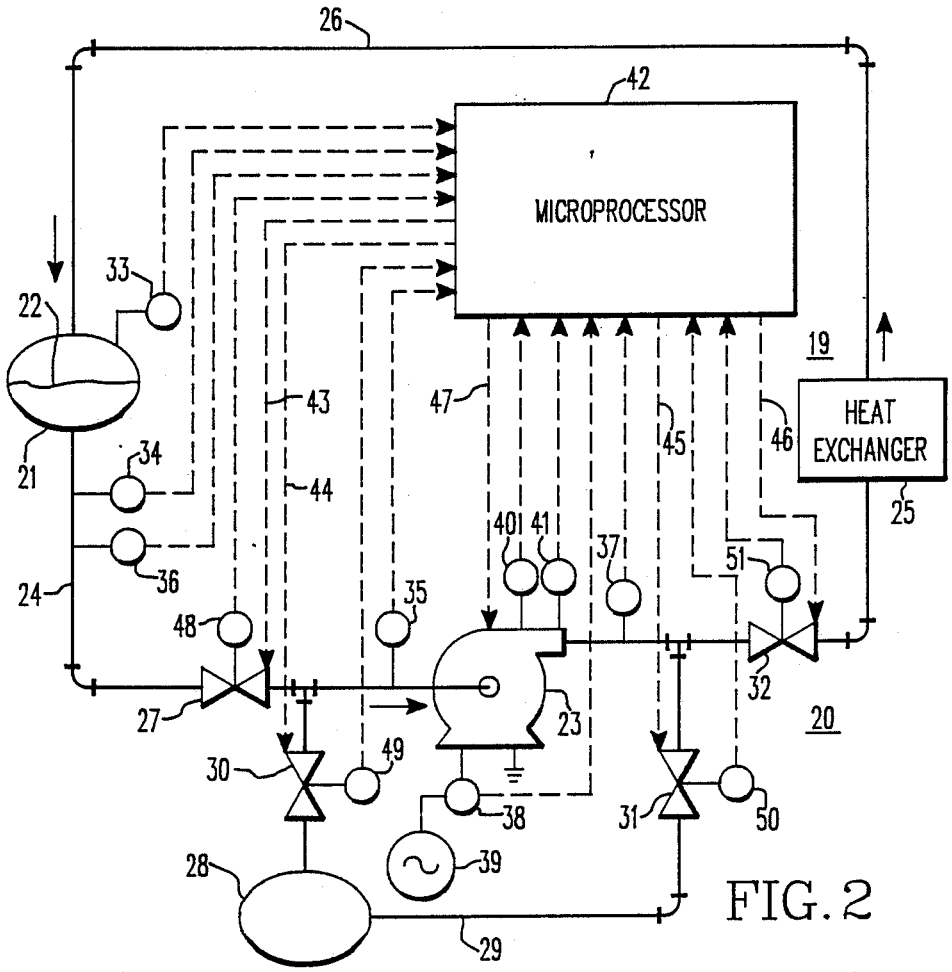
FIG. 2 illustrates an automatic pump protection system constructed according to the teachings of the present invention.

In FIG. 2, an automatic pump protection system 19 constructed according to the teachings of the present invention is illustrated in conjunction with a residual heat removal system (RHRS) 20 which recirculates and cools water from a reactor coolant system (RCS) 21 in a nuclear power plant (not shown). In certain modes of plant operation, the water level 22 in the RCS 21 is lowered to mid-pipe level. During these modes, a pump 23 of the RHRS 20 takes suction from the RCS 21 through a suction line 24, passes it through a heat exchanger 25 and injects the cooled water back into the RCS 21 through a line 26. Considering that under these conditions the flow rate of water through the RHRS 20 is fairly high (1500–2000 gpm) and that the level of water remaining in the RCS 21 is fairly low, the potential exists for air entrainment, vortexing, or a total loss of suction to the RHRS pump 23. The total loss of suction could occur due to either a loss of fluid from the RCS 21 or a spurious closure of an isolation valve 27 in the suction line 24 from the RCS 21 to the RHRS 20. If any of these conditions exist, the RHRS pump 23 could experience damage in the form of either pump heatup due to continued operation under air-binding conditions (no fluid in pump casing) or casing or impeller physical damage due to steam void collapse on the metal surfaces (cavitation).

Although the present invention is illustrated in the environment of an RHRS 20 of a nuclear power plant, such illustration is not intended as a limitation. The concepts of the present invention are applicable to numerous systems wherein expensive or inaccessible pumps are used.

An alternate suction source 28 is also illustrated along with an alternate suction line 29 and a series of isolation valves 30, 31 and 32. Isolation valves 30, 31 and 32, along with the suction line isolation valve 27, can be operated in such a way as to isolate the pump 23 from the RCS 21 which is the main suction source and connect it to the alternate suction source 28. This may be accomplished by closing the suction line isolation valve 27 along with isolation valve 32 and opening isolation valves 30 and 31 in the alternate suction line 29.

Analog variables related to loss of suction conditions may include pressure, temperature, fluid flow rate and fluid level. A fluid level sensor 33 is placed in the RCS 21 to monitor water level 22. A pressure sensor 34 is located at the RCS 21 outlet. A second pressure sensor 35 is located at the RHRS pump 23 intake, thereby facilitating the measurement of a pressure differential between these two points. The water temperature in the suction line 24 is measured through the use of a temperature sensor 36. Fluid flow rate is measured at the pump 23 outlet with a fluid flow rate sensor 37.

Analog variables related to pump motor conditions may include motor electrical current level, motor vibration level and motor sound frequency/intensity. An ammeter 38 measures the current drawn by the pump motor (not shown) from a power source 39. A sensor 40 measures motor vibration level; an additional sensor 41 measures motor sound frequency/intensity. The sensors illustrated in FIG. 2 may be any commercially available sensors.

A microprocessor 42 samples the analog process variables on a real-time basis. Status points associated with switches 48, 49, 50 and 51 and corresponding to the position of isolation valves 27, 30, 31 and 32 are also monitored to facilitate the detection of a loss of suction condition. The microprocessor 42 controls the position of valves 27, 30, 31 and 32 through control lines 43, 44, 45 and 46, respectively. The microprocessor 42 is also capable of automatically tripping pump 23 through control line 47.

Figure 3:
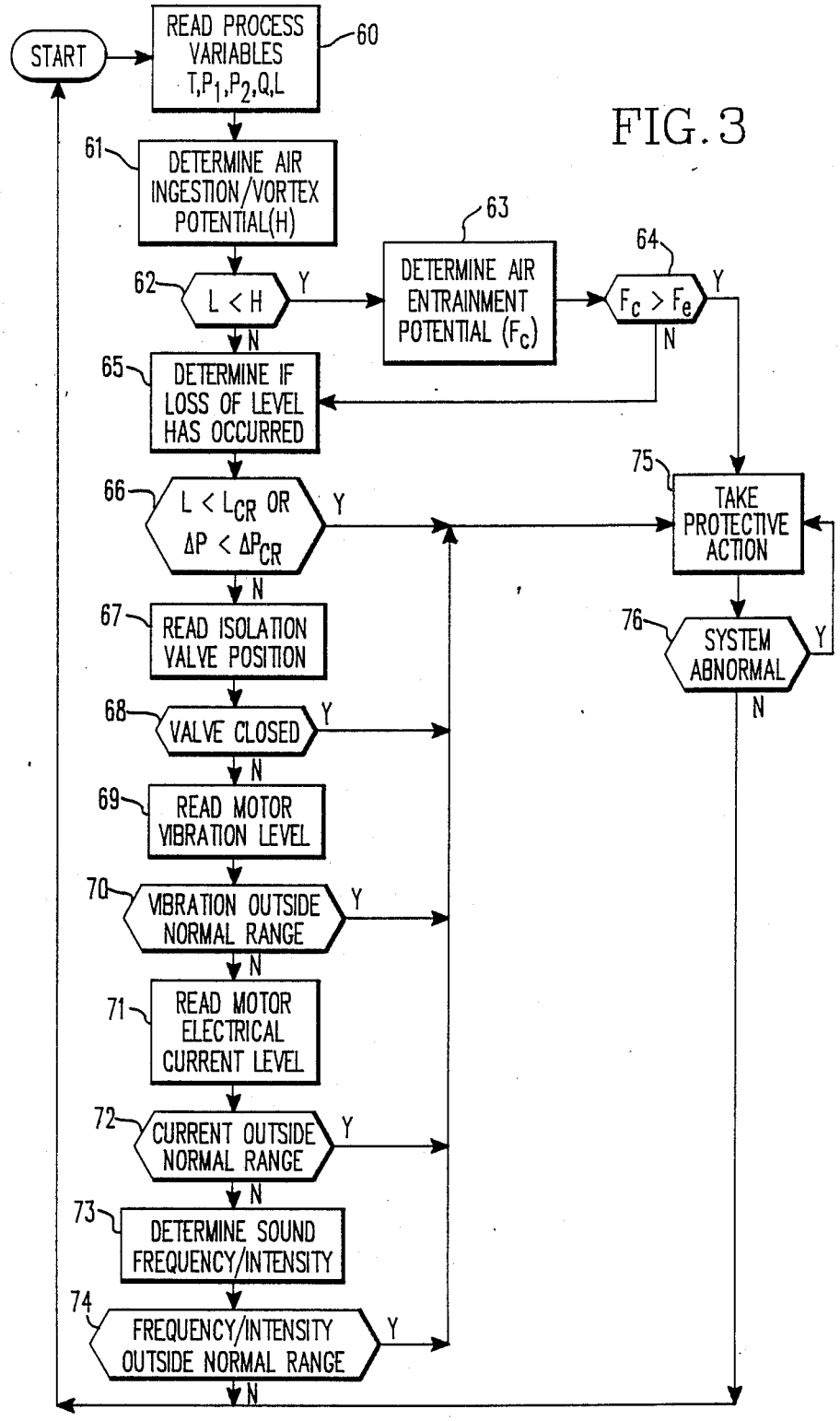
FIG. 3 is a flow chart illustrating the steps performed by the microprocessor of the automatic pump protection system shown in FIG. 2.

The operation of system 19 shown in FIG. 2 may be implemented as illustrated in the flow chart of FIG. 3. The flow chart begins at step 60 where the microprocessor 42 of FIG. 2, through known data acquisition techniques, samples the following parameters through the indicated sensors of FIG. 2: suction line temperature (T-sensor 36), suction line pressures ($P_1$ and $P_2$-sensors 34 and 35), fluid flow rate (Q-sensor 37) and RCS fluid level (L-sensor 33).

The microprocessor 42 then performs an analysis to determine air ingestion/vortex formation potential in step 61. One method of performing such analysis is through the use of the Harleman Equation as discussed in Simpson, *Sizing Piping For Process Plants*, Chemical Engineering, June 17, 1968, at 192, 205–206 which is hereby incorporated by reference. The Harleman Equation can be expressed as follows:

$$\frac{V_L}{\sqrt{g_L D}} = 3.24K\,(H/D)^{2.5}$$

Where $V_L$ = superficial average velocity of liquid (ft/sec)

$$g_L = \frac{g(\rho_L - \rho_G)}{\rho_L}$$

$g$ = 32.17 ft/sec$^2$ (gravitational constant)

$\rho_L$ = density of liquid (lb/ft$^3$)

$\rho_G$ = density of gas (lb/ft$^3$)

$D$ = diameter of pipe (ft)

$K$ = factor dependant upon fluid line geometry $H$ = level of fluid above the tank outlet (ft)

$V_L$ can be calculated from the fluid flow rate while the densities of the liquid and gas can be determined from the suction line temperature and suction line pressure. Pipe diameter, pipe area and the factor K used in these calculations are stored in a data base structure within microprocessor 42. The equation may then be solved for H, the minimum level of fluid above the RCS 21 outlet which will ensure that air is not ingested into the system.

In step 62, the microprocessor 42 compares the RCS fluid level 22 with the minimum required fluid level H as calculated in step 61. If the RCS fluid level 22 is greater than level H as calculated in step 61, then the program control continues with step 65. However, if the RCS fluid level 22 is less than level H as calculated in step 61, then the potential for vortex formation exists and program control continues with step 63.

In step 63, the microprocessor 42 performs an analysis to determine whether the potential for air entrainment exists. One method for performing this analysis is through the use of the Froude number which can be expressed as follows:

$$N_{Fr} = \frac{V_L}{\sqrt{g\,D}}\sqrt{\frac{\rho_L}{\rho_L - \rho_G}}$$

Where $V_L$ = superficial average velocity of the liquid (ft/sec)

$g$ = 32.17 ft/sec$^2$ (gravitational constant)

$D$ = diameter of pipe (ft)

-continued $\rho_L$ = density of liquid (lb/ft$^3$)

$\rho_G$ = density of gas (lb/ft$^3$)

The instantaneous Froude number ($F_c$) can then be determined from the liquid velocity and liquid and gas densities as calculated in step 61 and the pipe diameter stored in a data base structure.

Through the use of standard empirical techniques, a minimum Froude number can be determined at which air entrainment will occur, i.e., air ingested into the system will be swept along through the RHRS 20. This Froude number is stored in a data base structure. In step 64 the calculated instantaneous Froude number ($F_c$) of step 63 is compared to this experimental Froude number ($F_e$). If the calculated Froude number ($F_c$) is greater than the experimental Froude number ($F_e$) then the potential for air entrainment exists and the microprocessor performs the protective actions of step 75 by tripping the pump 23 or providing an alternate suction source 28. If the calculated Froude number ($F_c$) is less than the experimental Froude number ($F_e$), self venting of the ingested air will occur and the program control continues with the step 65.

In step 65, the pressure differential between the RCS 21 outlet and the RHRS pump 23 intake is calculated by comparing the readings provided by pressure sensors 34 and 35. The RCS fluid level 22 is compared to a critical fluid level and the pressure differential is compared to a critical pressure differential in step 66. These critical values are stored in a data base structure. If either of these comparisons indicates a fluid level or pressure differential less than the critical value, the microprocessor 42 initiates the protective actions of step 75. Otherwise, the program control continues with step 67.

Suction line isolation valve position is determined through the corresponding status point 48 by the microprocessor 42 in step 67. If the suction line isolation valve 27 of FIG. 2 is closed, then the microprocessor 42 in step 68 initiates the protective actions of step 75. If the isolation valve 27 is open, program control continues with step 69.

In each of steps 69, 71 and 73, the pump motor vibration level, electrical current level and sound frequency/intensity is sampled. These sampled parameters are compared to critical values provided by the pump manufacturer or derived from standard empirical studies and which are stored in a data base structure in steps 70, 72 and 74. If any of the pump motor parameters is outside the normal range, the protective actions of step 75 are taken. Otherwise, program control passes serially through these steps and returns to step 60.

After any protective actions are initiated in step 75, the microprocessor 42 continues to monitor, in step 76, the current status of the system. When the RHRS 20 has returned to a normal operating condition, i.e., the RHRS pump 23 is not tripped nor connected to the alternate suction source 28, program control is returned to step 60.

The flowchart shown in FIG. 3 illustrates one possible method of operating the system 19 shown in FIG. 2. It is anticipated that those of ordinary skill in the art will recognize that other possible equations and methods for calculating air ingestion/vortex potential, etc. can be used. Thus, while the present invention has been described in connection with an exemplary embodiment thereof, it will be understood that many modifications and variations will be readily apparent to those of ordinary skill in the art. This disclosure and the following claims are intended to cover all such modifications and variations.

I claim as my invention:

1. A system for automatically protecting a pump, comprising:

means for measuring process parameters indicative of a loss of pump suction;

first means responsive to said means for measuring for determining whether conditions leading to vortex formation are present;

second means responsive to said first means for determining and said means for measuring for determining whether conditions leading to air entrainment are present; and means for automatically initiating pump protective action in response to said second determination.

2. The system of claim 1 wherein said means for measuring said process parameters include means for measuring temperature, pressure, fluid flow rate and fluid level.

3. The system of claim 1 wherein said means for automatically initiating pump protective action include means for automatically tripping the pump.

4. The system of claim 1 wherein said means for automatically initiating pump protective action include means for providing an alternate suction source.

5. The system of claim 1 further comprising means for measuring pump motor vibration level and means for determining whether said vibration level is indicative of a pump failure condition.

6. The system of claim 1 further comprising means for measuring pump motor electrical current level and means for determining whether said current level is indicative of a pump failure condition.

7. The system of claim 1 further comprising means for measuring pump motor sound frequency/intensity and means for determining whether said frequency/intensity is indicative of a pump failure condition.

8. The system of claim 1 wherein said means for measuring said process parameters include means for measuring fluid level and pressure.

9. The system of claim 8 wherein said first means responsive to said means for measuring include means for determining whether the fluid level has dropped to a critical level.

10. The system of claim 1 wherein said means for measuring said process parameters include means for determining isolation valve position.

11. The system of claim 10 further comprising means for determining whether the isolation valve is closed.

12. A residual heat removal system having automatic pump protection, comprising:

a pump;

a suction line connecting said pump to a suction source;

means for measuring suction line parameters indicative of a loss of pump suction;

first means responsive to said means for measuring for determining whether conditions leading to vortex formation are present;

second means responsive to said first means for determining and said means for measuring for determining whether conditions leading to air entrainment are present; and means for automatically initiating pump protective action in response to said second determination.

13. A method for automatically protecting a pump, comprising the steps of:

measuring process parameters indicative of a loss of pump suction;

determining whether conditions leading to vortex formation are present in response to said parameters;

determining whether conditions leading to air entrainment are present in response to said parameters and said first determination; and automatically initiating pump protective action in response to said second determination.

14. The method of claim 13 wherein the step of measuring said process parameters includes the step of measuring temperature, pressure, fluid flow rate and fluid level.

15. The method of claim 13 wherein the step of automatically initiating pump protective action includes the step of automatically tripping the pump.

16. The method of claim 13 wherein the step of automatically initiating pump protective action includes the step of providing an alternate suction source.

* * * * *